US007802977B2

(12) United States Patent
Schröter et al.

(10) Patent No.: US 7,802,977 B2
(45) Date of Patent: Sep. 28, 2010

(54) APPARATUS FOR MELT SPINNING AND WINDUP OF SYNTHETIC YARN

(75) Inventors: Michael Schröter, Remscheid (DE); Helmut Weigend, Radevormwald (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 119 days.

(21) Appl. No.: 12/181,009

(22) Filed: Jul. 28, 2008

(65) Prior Publication Data

US 2009/0022833 A1 Jan. 22, 2009

Related U.S. Application Data

(63) Continuation of application No. PCT/EP2006/007198, filed on Jul. 21, 2006.

(30) Foreign Application Priority Data

Jan. 26, 2006 (DE) ..... 10 2006 003 640

(51) Int. Cl.
*D01D 7/00* (2006.01)

(52) U.S. Cl. ..... 425/66; 425/72.2; 425/377; 425/382.2; 425/404; 425/445; 425/464

(58) Field of Classification Search ..... 425/66, 425/72.2, 377, 382.2, 404, 445, 464
See application file for complete search history.

(56) References Cited

U.S. PATENT DOCUMENTS 3,544,017 A * 12/1970 Schippers et al. ..... 425/66

(Continued)

FOREIGN PATENT DOCUMENTS

DE 1 660 311 3/1972

(Continued)

OTHER PUBLICATIONS

The International Search Report for International Application No. PCT/EP2006/007198, completed Nov. 6, 2006.

(Continued)

*Primary Examiner*—Yogendra N Gupta
*Assistant Examiner*—Joseph Leyson
(74) *Attorney, Agent, or Firm*—Alston & Bird LLP

(57) ABSTRACT

An apparatus for melt spinning and winding up synthetic yarns comprising a spinning appliance, a treating appliance and a windup machine. The treating appliance comprises a runoff godet for guiding the yarns before entry and distribution of the yarns into a plurality of winding stations in the windup machine, the runoff godet being arranged above the windup machine and guiding the yarns in a parallel side by side arrangement on its circumference. The runoff godet is arranged transversely to a winding spindle and above the windup machine, the windup machine comprising a plurality of head yarn guides which are disposed upstream of the winding stations and are arranged in a vertically oriented runup plane. To ensure a very low-friction guidance for the yarns, the invention provides that the head yarn guides of the winding stations are disposed downstream of the runoff godet immediately in the yarn path and such that on deflection of the yarns into the runup plane an angle of deflection of not more than 15° is not exceeded.

12 Claims, 6 Drawing Sheets

U.S. PATENT DOCUMENTS

| | | | | |
|---|---|---|---|---|
| 3,844,496 | A * | 10/1974 | Rothert | 242/485.9 |
| 5,794,868 | A | 8/1998 | Busenhart et al. | |
| 6,494,700 | B1 | 12/2002 | Stammen | |
| 7,322,811 | B2 | 1/2008 | Schröter | |
| 2006/0003037 | A1 * | 1/2006 | Kirchhoff et al. | 425/66 |

FOREIGN PATENT DOCUMENTS

| | | | |
|---|---|---|---|
| WO | WO 99/37835 | A1 | 7/1999 |
| WO | WO 2004/015173 | A1 | 2/2004 |
| WO | WO 2004/074155 | A1 | 9/2004 |

OTHER PUBLICATIONS

The International Preliminary Report on Patentability for International Appl. No. PCT/EP2006/007198, mailed Sep. 18, 2008.

* cited by examiner

APPARATUS FOR MELT SPINNING AND WINDUP OF SYNTHETIC YARN

CROSS-REFERENCE TO RELATED APPLICATIONS

The present application is a Continuation of International Application No. PCT/EP2006/007198, filed Jul. 21, 2006, and which designates the U.S. The disclosure of the referenced application is incorporated herein by reference.

FIELD OF THE INVENTION

This invention relates to an apparatus for melt spinning and windup of synthetic yarn.

BACKGROUND OF THE INVENTION

Congeneric apparatus for melt spinning and windup of synthetic yarn is described in WO 2004/015173 A1.

It is common general knowledge in the arts of producing synthetic yarn that the synthetic yarns are each extruded in a parallel side-by-side arrangement in a spinning appliance from a polymer melt to form a multiplicity of strands of filament, which are cooled down and bundled. The yarns are subsequently guided in parallel, preferably by godet systems, in a treating appliance to then be wound up in a parallel manner at the end in a windup machine to form bobbins. In the process, from the melt spinning stage to the windup stage, the yarns are guided with different yarn spacings relative to each other. Initially, in the spinning appliance, a spin spacing is maintained between each of the yarns, which is essentially due to the die pitches of the spinneret die packs. After cooling, the yarns are gathered together to be guided conjointly through the treating appliance spaced apart by a significantly smaller treatment spacing. The treatment spacing is essentially maintained between the yarns up to before entry into the windup machine. In the windup machine, a wind spacing must be maintained between the yarns, which is essentially due to the width of the bobbins of the individual winding stations. The yarn sheet thus undergoes spreading apart from the treatment spacing to the wind spacing.

The areas of transition between the spinning appliance and the treating appliance and also between the treating appliance and the windup machine are thus provided with yarn guiding means adapted to allow individual yarns to be diverted or deflected to the particular yarn spacing desired. In addition, it has to be ensured that the yarns can be guided safely and without mutual contact in the appliances, particularly in the godets of the treating appliance. Care must further be taken to ensure that the diversions generated by yarn guiding means do not generate impermissible yarn tensions due to high wrap friction. In this respect, certain angles of diversion have to be observed in the regions of transition, in particular in relation to the yarns on the outside. An additional aggravation in relation to the windup of the yarns is that each friction-based deflection on the yarn leads to an increase in the yarn pulling force and thus influences the winding tension at the windup of the yarn on the bobbin.

Recent developments for optimizing yarn travel relate particularly to the yarn transition from the treating appliance to the windup machine.

WO 2004/015173 A1 discloses apparatus wherein the yarns are distributed via a runoff godet situated above the windup machines in a horizontally oriented runoff plane and essentially transversely to the longitudinal axis of the windup machine. Placing the runoff godet at a front end of the windup machine makes it possible to effect distribution out of the runoff plane, so that low spacings are achievable between the windup machine and the treating appliance, which lead to compact and hence handling-friendly machine designs.

WO 2004/074155 A1 discloses a further apparatus wherein the yarns are distributed to the winding stations of the windup machine through a runoff godet disposed vertically and to the side of the windup machine. Here, the yarns are led in a vertically oriented runoff plane which is positioned in relation to the winding stations such that simple diversion brings about a distribution into the winding stations.

Both the known apparatuses constitute ways of leading the yarns in the treating appliance parallel to each other and with a very small treatment spacing and subsequently for them to be distributed to the individual winding stations with a larger distance relative to each other. The prior art apparatuses utilize yarn guiding means to obtain certain yarn paths and diversions.

It is an object of the present invention to develop a congeneric apparatus such that a yarn sheet supplied by a treating appliance can be supplied to the winding stations of the windup machine with a minimum of friction and with no significant yarn tension differences.

SUMMARY OF THE INVENTION

This object and others are achieved according to the present invention by an apparatus having the features described and claimed herein.

The present invention does away with the preconceived notion that, at hauloff of a parallel yarn sheet on a godet surface into a middle plane, it is inevitable for the runoff points of the outer yarns on the circumference of the godet to be displaced in the direction of the middle plane and that a bunching together of the threads at runoff of the godet surface is thus inevitable. It has been determined that these effects differ as a function of the angle of deflection. It has thus been found that the runoff points on the godet surface of the parallel yarns running off cause essentially unchanged or uncritical displacements of the runoff points on the godet at a maximum angle of deflection of 15° relative to the middle plane.

The stated object and others are accordingly achieved when the head yarn guides of the winding stations, which are held in the vertically oriented runup plane, are disposed immediately in the yarn path of the runoff godet such that, on deflection of the yarns out of the runoff plane which is formed by the godet and which is 90° twisted relative to the runup plane, an angle of deflection of not more than 15° is not exceeded. The distribution of the yarns from the treating appliance to the windup machine can thus be advantageously executed without any additional yarn guiding means. Limiting the angle of deflection ensures that the treatment spacing of the yarns, which is crucial for their being led in parallel, remains unchanged in the treating appliance and particularly on the runoff godet. The yarns having run off the runoff godet are immediately led into the traversing triangle of the winding stations. The diversion of the yarns and also the bounding of the traversing region are simultaneously determined by the head yarn guides.

The constant position of the runoff points on the godet circumference particularly of the outermost, most strongly deflected yarns is improved when the surface of the runoff godet has a roughness in the range of an average roughness value from 0.2 μm to 0.8 μm. Preferably, a range of 0.4 μm to 0.65 μm is set to obtain high adhesions to the godet surface of the yarns which are typically wetted with a spin finish. Higher surface roughnesses lead to unacceptable slippage phenomena, which impair the guidance and treatment of the yarns. However, still smaller average roughness values require an appreciable fabrication expense for the godet surface.

To be able to wind a plurality of yarns using commercially available windup machines, particular preference is given to that further development of this invention where the runoff godet is preceded by a guiding means for guiding a plurality of parallel yarns whereby a spacing in the range from 2 mm to 8 mm is determined between the yarns. This yarn spacing predetermined by the guiding means thus constitutes the yarn spacing to be maintained in the treating appliance for treating the yarns. It is thus possible to realize short and compact designs for simply or multiply wrapped godets in particular. Furthermore, even for a high number of yarns a distribution according to the present invention, without yarn guiding means, becomes possible.

Useful guiding means for inclusion in the yarn path on the upstream side of the runoff godet include a plurality of yarn guides arranged side by side in a row which are formed by ceramic pins or comb-shaped ceramic guides for example.

However, it is also possible to form the guiding means directly by a plurality of radial guiding grooves on the circumference of the runoff godet. The yarns are thus guided directly on the circumference of the godet in the guiding grooves.

When there are a multiplicity of simultaneously guided yarns, preference is given to that further development of this invention where the runup plane defined by the head yarn guides intersects the axis of the runoff godet in the middle guiding region of the yarn guiding system. It is thus possible to achieve an advantageous distribution even for a multiplicity of yarns without mutual interference in the yarn guiding system. To obtain a symmetrical deflection on the part of the outer yarns, however, it is advisable to place the runup plane asymmetrically relative to the guiding region.

The treating appliance preferably comprises a plurality of driven godets to guide and draw the yarns, the runoff godet being assigned at least a second godet in the yarn path. It is thus possible to fully integrate the runoff godet in the treating appliance without any need for additional guiding godets. Godet systems can be used that effect partial or full drawing of the yarns.

However, it is also possible to utilize the runoff godet independently of the treating appliance for the distribution of the yarns exclusively.

To be able to execute the entangling of the yarns, which is typically carried out before windup, independently of the winding tension, a further advantageous embodiment of this invention disposes an entangling appliance between the runoff godet and the assigned godet, the yarns being synchronously entangled while in a parallel side-by-side arrangement. The tension settings required for entangling the yarns are made between the godets.

To further minimize yarn friction, a preferred variant of the present invention proposes forming the head yarn guides in the windup machine by in each case freely rotatable guiding rollers whose roller axes are oriented essentially orthogonally to a winding spindle of the windup machine. This makes it possible to execute even comparatively large yarn diversions with low friction, so that the distance between the runoff godet and the head yarn guides which has been chosen for the distribution of the yarns can be made small.

In order that guiding rollers having essentially smooth guiding surfaces ensure secure guidance of the yarns running up, a particularly advantageous configuration for the apparatus of the present invention is one where the roller axes of the guiding rollers have an inclination angle relative to the axis of the runoff godet as a function of the respective angle of deflection of the assigned yarn. This makes it possible to let the yarns run up to the guiding rollers at essentially right angles.

However, the guiding of the yarns can also be improved by the guiding rollers each comprising in their circumference a flute-shaped guiding track in which the yarn running up is guided.

Owing to the low number of yarn guiding means in steady state operation, it is particularly important to further develop the invention in order that yarn guiding operations may be executed during a processing start, a processing interruption and/or a bobbin change in the windup machine. There are thus provided one or more auxiliary appliances which are selectively activable and handleable by an operative in order that the yarns may be placed in the appliances and guided or in order that the guidance of the yarns may be ensured on the respective appliances during a processing interruption or a bobbin change.

The apparatus of the present invention has the particular advantage that for every one of the winding stations the yarn supplied is supplied to the winding stations with essentially low friction. Only the yarn tension buildup due to the diversion of the yarn at the head yarn guide occurs, but that yarn tension buildup is essentially the same at every winding station.

BRIEF DESCRIPTION OF THE DRAWINGS

The apparatus of the present invention will now be more particularly described with reference to some operative examples and to the accompanying figures, in which.

DETAILED DESCRIPTION OF PREFERRED EMBODIMENTS

Figure 1:
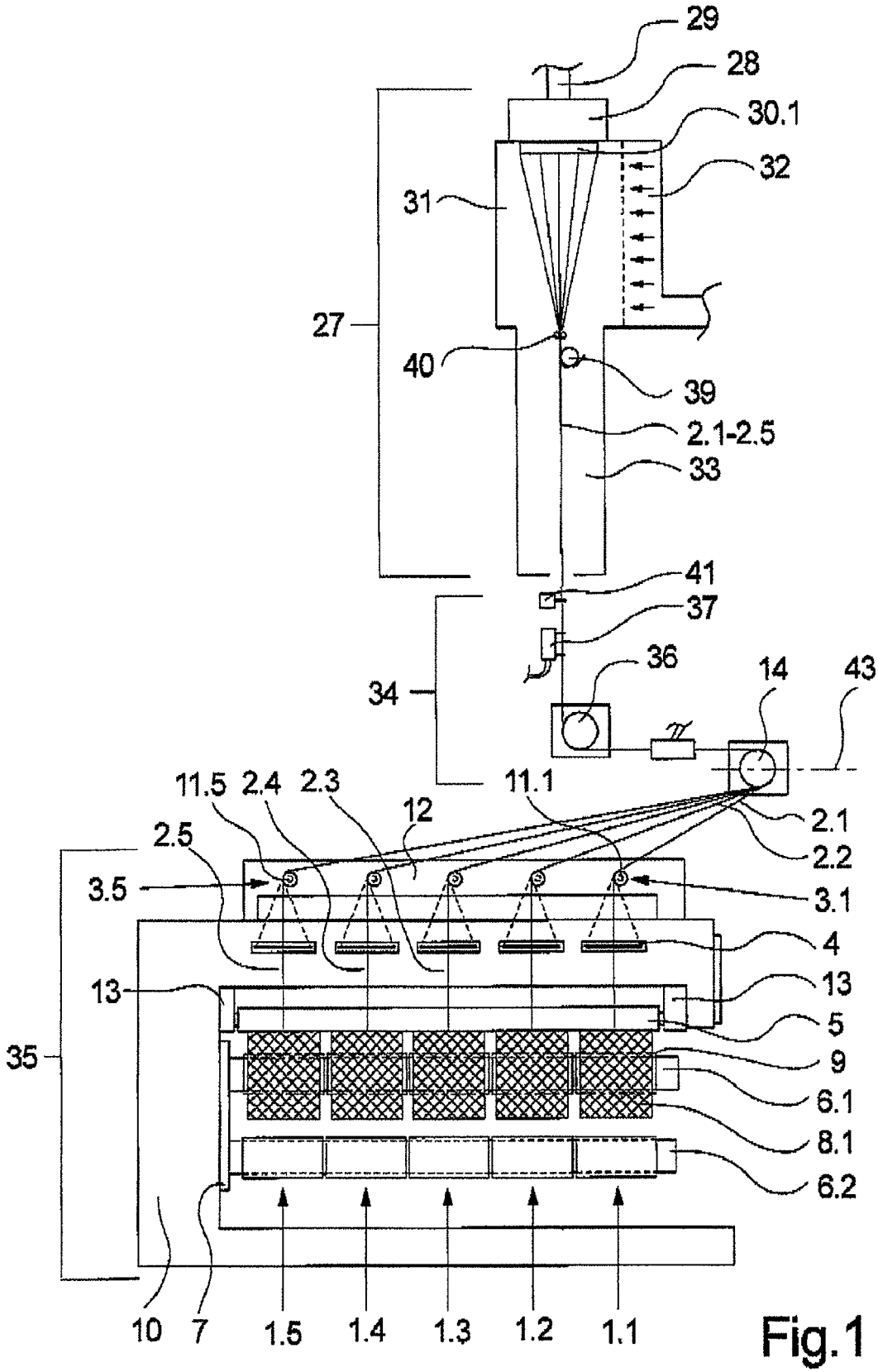
FIG. 1 is a schematic side view of a first operative example of the apparatus of the present invention.
Figure 2:
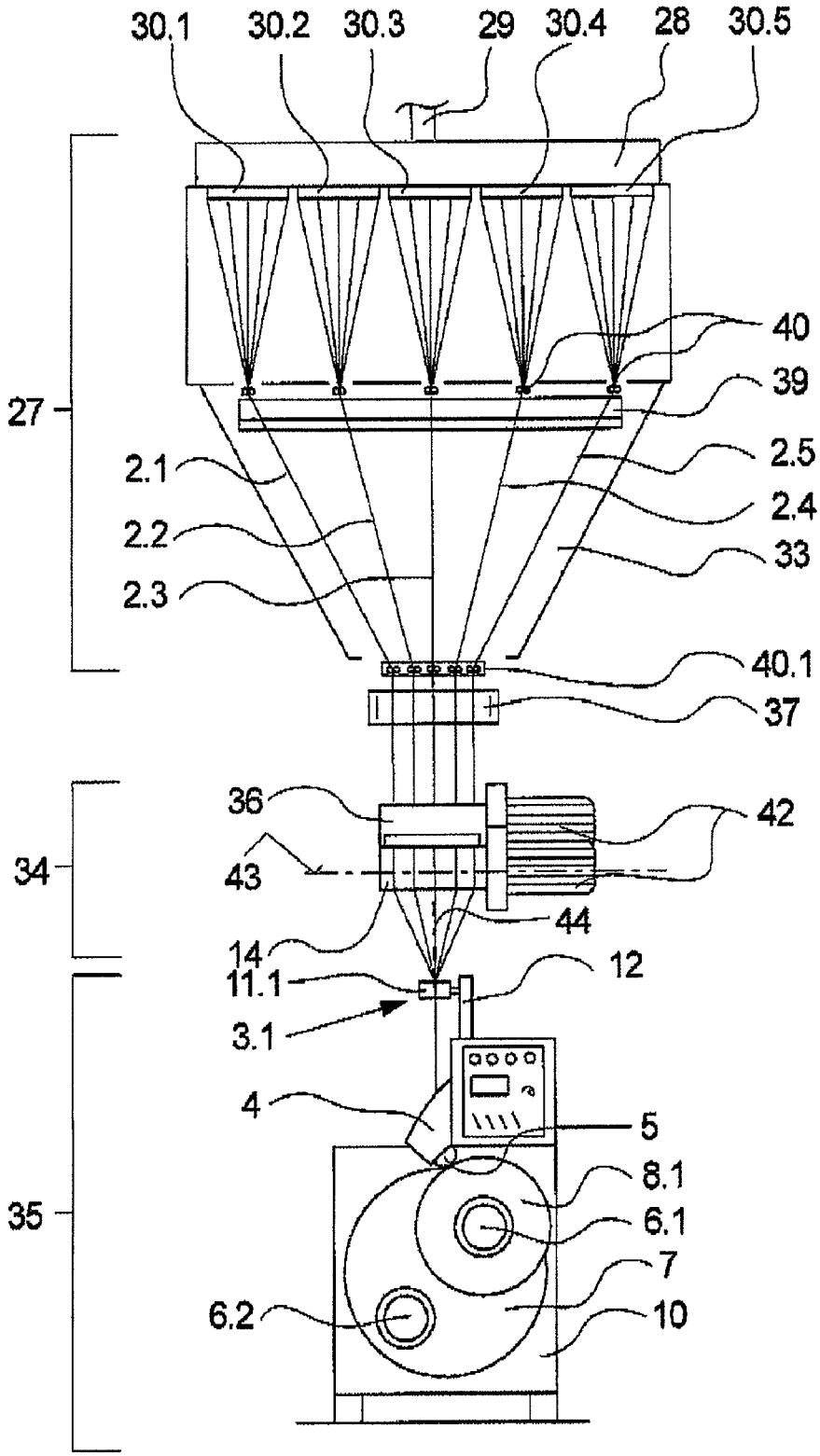
FIG. 2 is a schematic front view of the operative example of FIG. 1.
Figure 3:
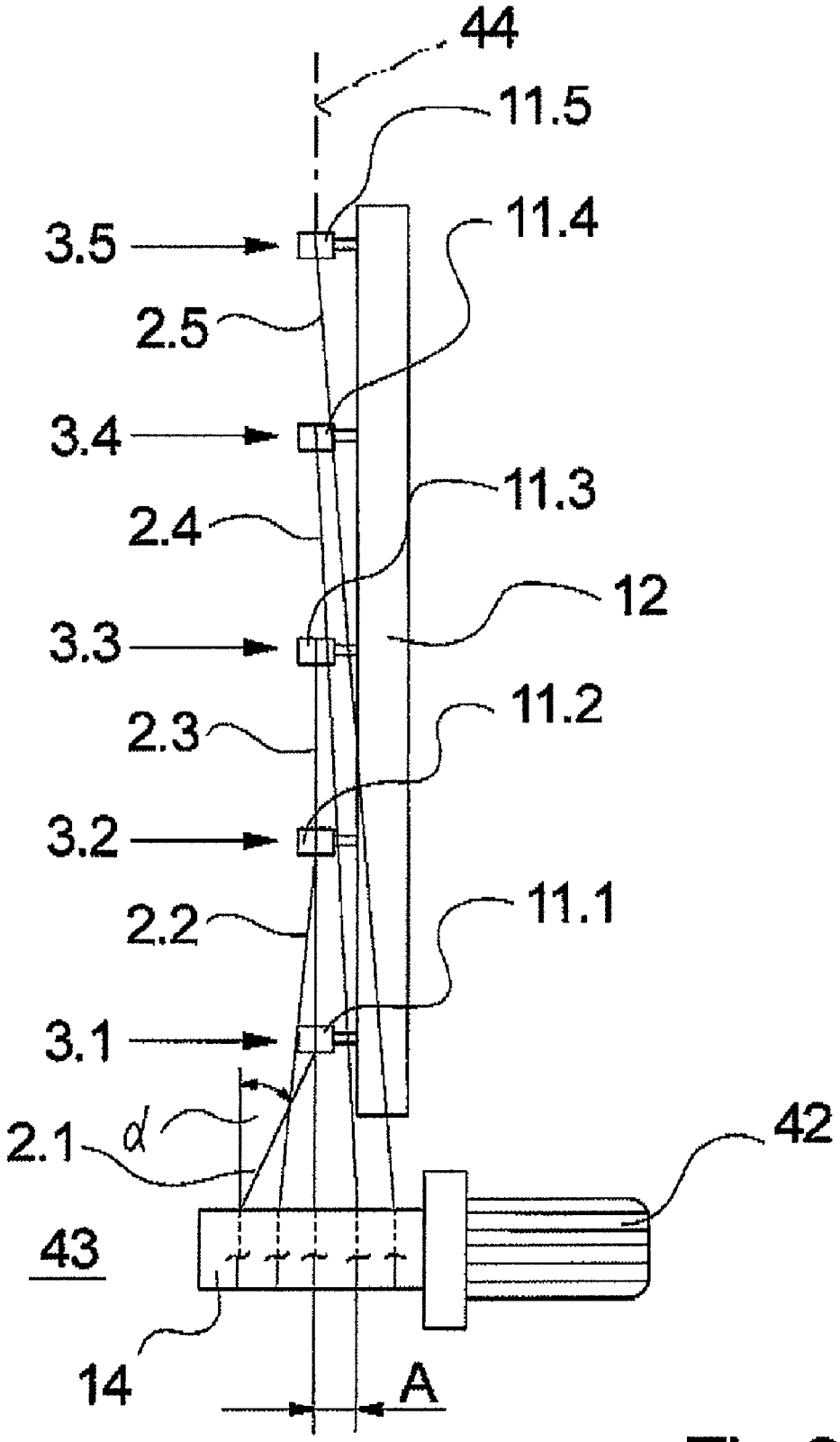
FIG. 3 is a schematic view of a detail of a plan view of the operative example of FIG. 1.

FIGS. 1, 2 and 3 depict a first operative example of the apparatus of the present invention in a plurality of views. FIG. 1 shows the apparatus in a side view, FIG. 2 shows the apparatus in a front view and FIG. 3 shows the apparatus in a detail from a plan view. The description hereinbelow applies to all the figures if no express reference is made to one of the figures.

The apparatus of the present invention comprises a spinning appliance 27, a treating appliance 34 and a windup machine 35, and a plurality of synthetic yarns are produced in a parallel side by side arrangement. The spinning appliance 27 contains a plurality of spinneret dies on an underside of a heated spinning beam 28 which is connected via a melt feed 29 to a melt source, for example an extruder. In the operative example, altogether five spinneret dies 30.1 to 30.5 are arranged in a row side by side. The number of spinneret dies is illustrative in that fewer or more yarns can be simultaneously spun by means of one spinning appliance. Each of the spinneret dies 30.1 to 30.5 possesses a multiplicity of die holes to extrude a filament bundle of a multifil yarn from each polymer melt supplied via the melt feed. Before the individual extruded strands of filament of the filament bundle are gathered together to form the respective yarns 2.1 to 2.5, the filament bundles pass through a cooling shaft 31 disposed underneath the spinning beam 28. The cooling shaft 31 is combined with a quench air system 32, so that a stream of cooling air acts on the filament bundles within the cooling shaft 31. The cooling air stream may—as depicted—be generated by a cross flow quench. However, it is also possible for the cooling air stream to be generated by a cooling cylinder with a surround quench directed from out to in or from in to out.

The outlet region of the cooling shaft 31 is equipped with a spin finishing apparatus 39 and a plurality of yarn guides 40 to gather the filament bundles together to form the respective yarns 2.1 to 2.5. The cooling shaft 31 is directly followed by a falling shaft 33 to guide the yarns 2.1 to 2.5 to the treating appliance 34.

Underneath the falling shaft 33 there is disposed a yarn guide strip 41 and also a yarn collecting apparatus 37, the yarn guide strip 41 forming with each of the yarns 2.1 to 2.5 a yarn guiding system through which a treatment spacing is set between each of the yarns 2.1 to 2.5. For this, the yarns 2.1 to 2.5 are gathered together via the yarn guides 40 from the spinning pitch upward to the yarn guide strip 41 to the treatment spacing.

The yarn guide strip 41 is assigned to the yarn collecting apparatus 37 through which the yarn sheet is brought together in the event of yarn breakage and led away via an aspirating system. The yarn collecting apparatus 37 possesses a mobile guiding means and an aspirating system to be able to collect the yarns 2.1 to 2.5 in the event of yarn breakage. Such appliances are common general knowledge and described in EP 1 049 823 B1 (related to U.S. Pat. No. 6,494,700) for example.

The treating appliance 34 comprises at least a runoff godet 14, which is arranged directly upstream of the windup machine 35. The runoff godet 14 is arranged in the region of a front face of the windup machine, the spinning appliance 27 and the runoff godet 14 being arranged transversely to a longitudinal axis of the windup machine. Such an apparatus is known from EP 1 527 217 (related to U.S. Pat. No. 7,322,811), the contents of which are expressly incorporated herein by reference.

As well as the runoff godet 14, the treating appliance 34 comprises an upstream second godet, referred to as hauloff godet 36 in this example. The hauloff godet 36 hauls the yarns 2.1 to 2.5 out of the spinning appliance 27. The hauloff godet 36 and the runoff godet 14 are each driven by a godet drive 42. The circumferential speeds of the hauloff godet 36 and of the runoff godet 14 can be set to differ, depending on the process and the yarn type. The yarns 2.1 to 2.5 are guided in an S-shaped yarn path with the predetermined treatment spacing between the yarns in a parallel arrangement over the circumference of the hauloff godet 36 and of the runoff godet 14.

Underneath the treating appliance 34 is the windup machine 35. The windup machine 35 has altogether five winding stations 1.1 to 1.5 side by side in the windup machine. Each of the winding stations 1.1 to 1.5 is supplied with one of the yarns 2.1 to 2.5 and winds it to form a bobbin. The construction of the winding stations 1.1 to 1.5 is identical, so that the fundamental construction is described with reference to the winding station 1.1, which occupies the first position to an operative-access side.

The winding station 1.1 comprises a traversing means 4 whereby a supplied yarn 2.1 is moved from one side to the other within a traversing stroke. The traversing means 4 take the form for example of a reverse-threaded traverse, whereby a traversing yarn guide moves from one side to the other within a traversing stroke, or of a wing traverse comprising a plurality of wing tips which are driven in opposite directions and pull the yarn from side to side. The traversing means 4 is preceded by a head yarn guide 3.1 which forms the tip of a so-called traverse triangle. The head yarn guide 3.1 forms the inlet into the winding station 1.1.

To wind up the yarn 2.1 in the winding station 1.1, a bobbin center 9 is mounted on the circumference of a driven winding spindle 6.1. The winding spindle 6.1 extends over all neighboring winding stations 1.2, 1.3, 1.4 and 1.5, so that the supplied yarns 2.1 to 2.5 are wound up simultaneously in each of the winding stations 1.1 to 1.5.

To place the yarn 2.1 on the surface of the bobbin 8.1 in the winding station 1.1 there is a pressure roll 5 positioned between the traversing means 4 and the winding spindle 6.1. The pressure roll 5 likewise extends over the entire length of the winding stations 1.1 to 1.5. The yarn 2.1 partially wraps the circumference of the pressure roll 5 and is then deposited on the surface of the bobbin 8.1.

In the winding stations 1.1 to 1.5, the head yarn guides 3.1 to 3.5 are each formed by guiding rollers 11.1 to 11.5 which are mounted so as to be freely rotatable. The guiding rollers 11.1 to 11.5 are each positioned within the winding stations 1.1 to 1.5 so that their roller axes are orthogonal to the winding spindle 2.1. The guiding rollers 11.1 to 11.5 are held on a carrier 12 which is connected to a machine stand 10. The guiding rollers 11.1 to 11.5 preferably have a low-friction air mounting in order that there may be no additional buildup of tension on the yarns.

The machine stand 10 serves to receive and secure the traversing means 4, the pressure roll 5 and the winding spindle 6.1. In this operative example, the pressure roll 5 is held pivotably on the machine stand 10 via a swing 13. The winding spindle 6.1 is mounted protrudingly in a winding revolver 7 which is held rotatably in a machine stand 10. The winding revolver 7 holds (displaced by 180° relative to the winding spindle 6.1) a second winding spindle 6.2 in order that a continuous windup of the yarns may be performed in the winding stations 1.1 to 1.4. The winding revolver and also the winding spindles 6.1 and 6.2 are each assigned drives (not depicted here).

To distribute the yarns 2.1 to 2.5, the runoff godet 14 is directly assigned to the head yarn guides 3.1 to 3.5. The head yarn guides 3.1 to 3.5 form a vertically oriented runup plane 44. Against that, the runoff godet 14 is disposed in a horizontally oriented runoff plane 43 above the head yarn guides 3.1 to 3.5, the axis of the runoff godet 14 being oriented transversely to the longitudinal axis of the windup machine 35 or transversely to the winding spindle 6.1. The runoff godet 14 is held in the region of the front face of the windup machine 35, so that the yarns 2.1 to 2.5 running off the runoff godet 14 are guided to the side of the head yarn guides 3.1 to 3.5.

To further elucidate the distribution of the yarns 2.1 to 2.5 from the treating appliance 34 to the windup machine 35, FIG. 3 shows a detail of a plan view showing only the appliance objects relevant to the distribution of the yarns, such as the runoff godet 14 and the head yarn guides 3.1 to 3.5.

The head yarn guides 3.1 to 3.5 are each formed by the guiding rollers 11.1 to 11.5, which are each mounted on an axis 15 so as to be freely rotatable. The guiding rollers 11.1 to 11.5 are held on the carrier 12, the guiding rollers 11.1 to 11.5 each being at an identical distance from the traversing means not depicted here. The head yarn guides 3.1 to 3.5 form a vertically oriented runup plane 44, within which the yarns 2.1 to 2.5 are introduced. To this end, the yarns led parallel to the runoff plane 43 have to be deflected from the circumference of the runoff godet 14 according to the position of the yarns. The runoff plane 42 corresponds to the plane of the drawing of FIG. 3 or to a plane parallel thereto. In the operative example, the yarns 2.1 to 2.5 are led on the godet surface of the runoff godet 14 in an order such that the first yarn 2.1 is held on the free protruding end of the runoff godet 14 and are held in a parallel side by side arrangement in the order of the reference numerals, so that the yarn 2.5 is led on the mounting-side end of the runoff godet 14. Distribution of the yarns 2.1 to 2.5 to the individual winding stations requires that, following runoff off the runoff godet 14, the yarns have to be deflected to the runup plane 44 by an angle of deflection $\alpha$. The angle of deflection $\alpha$ is an angle of the triangle, projected on the runoff plane 43, between the yarn and a surface line of the runoff godet 14. The angle of deflection $\alpha$ for the deflection of the yarn 2.1 to the guiding roller 11.1 has been entered by way of example.

In the operative example depicted in FIG. 3, the runup plane 44, within which the head yarn guides 3.1 to 3.5 are arranged, is essentially central to the guiding region of the yarns on the surface of the runoff godet 14. This means that the central yarn 2.3 can be directly led in the runup plane 44 without deflection. Depending on the distance of the yarns 2.2, 2.3 and 2.5 from the runup plane 44, the yarns undergo a deflection into the runup plane 44 on the way to the corresponding head yarn guides 3.2, 3.3 and 3.5.

To ensure that yarns undergoing a deflection, particularly the outer yarns 2.1 and 2.5, have a stable runoff point on the circumference of the runoff godet 14, only limited deflection is possible. It has been determined that angles of deflection a in the region of not more than 15° do not occasion any significant yarn displacements on the circumference of the runoff godet 14. At larger angles of deflection, however, the runoff points of the outer yarns in particular undergo a displacement which directly leads to a coming together and contact of the yarns on the circumference of the runoff godet 14.

To improve adhesion to the surface of the runoff godet 14 of the yarns which are moistened by a spin finish, the surface of the runoff godet 14 is provided with a roughness in the region of an average roughness value $R_a$ from 0.2 μm to 0.8 μm. This provides stable yarn positions within the treating appliance which even permit yarn spacings A of 2 mm during the treatment of the yarns. This would enable even commercially available windup machines to be used to take up a multiplicity of yarns directly off a runoff godet 14. Typically, the spacings between the yarns guided in parallel in the treating appliance are chosen to be in a range of 2 mm to 8 mm. The drawing in FIG. 3 shows that not only the number of the yarns but also the spacing between the yarns and also the distance of the head yarn guides 3.1 to 3.4 from the runoff point on the runoff godet 14 have a crucial influence on the respective angle of deflection. Individually optimized combinations can be chosen in this respect depending on manufacturing process and yarn type.

The apparatus depicted in FIGS. 1 to 3 is particularly suitable for producing partially oriented yarns (POYs). The distribution of the yarns from the treating appliance 34 to the windup machine 35 without essentially any yarn guiding elements makes it possible to wind up and lead the yarns using minimal yarn tensions. The construction of the head yarn guides as guiding rollers ensures that even the necessary diversion of the yarns into the runup plane is made very low friction. The apparatus is accordingly suitable for very fine deniers as well as for coarse deniers.

Figure 4:
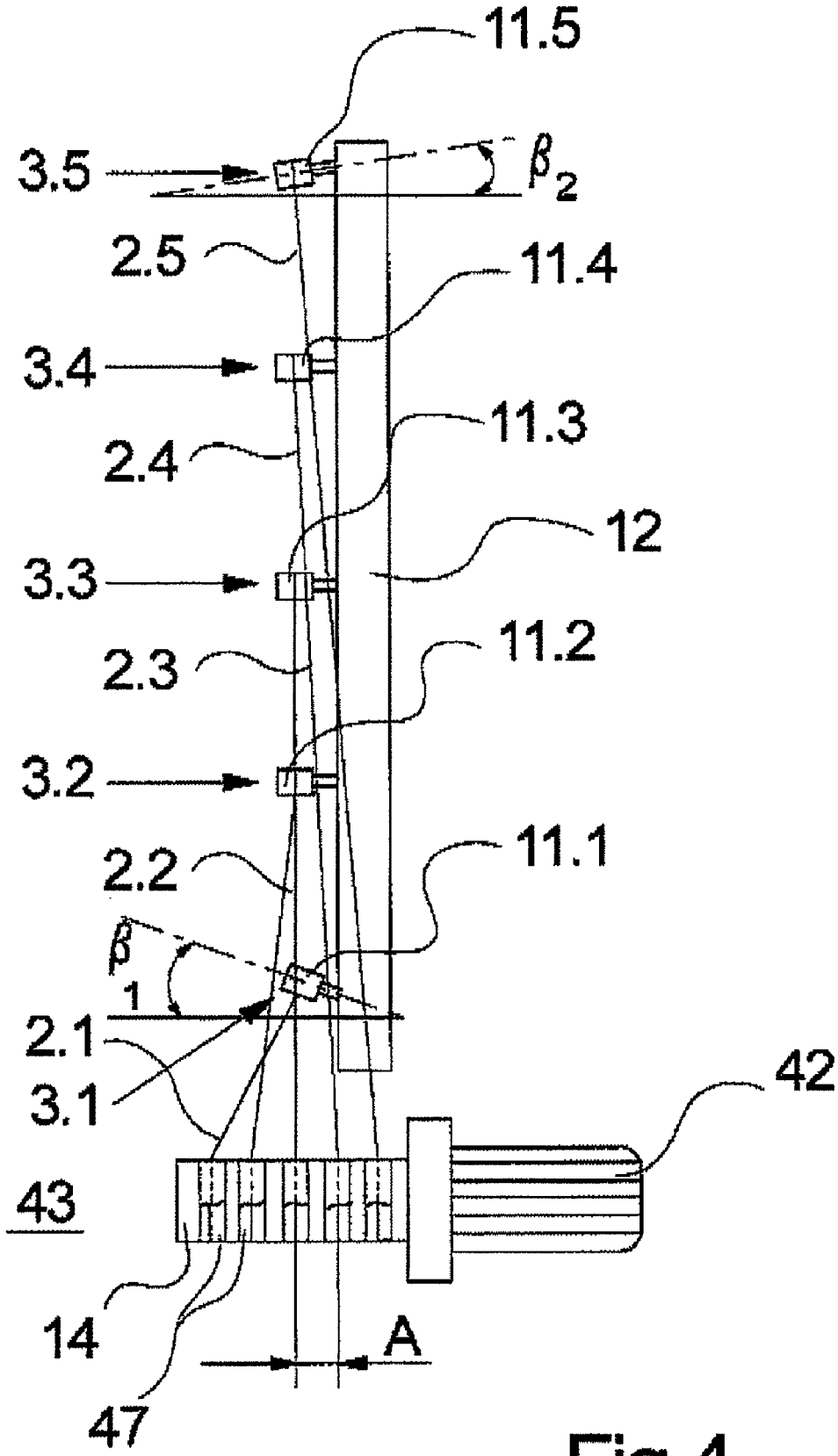
FIG. 4 is a schematic part view of a plan view of a further operative example of the apparatus of the present invention.

FIG. 4 shows a further operative example of the present invention's apparatus as details from a plan view, the operative example being identical to the preceding operative example, so that the preceding description is incorporated by reference and only the differences will be pointed out here.

The runoff godet 14 has one guiding groove 47 for each of the yarns 2.1 to 2.5 which is constructed to be radially circumferential on the circumference of the runoff godet 14. The yarns 2.1 to 2.5 are each guided in the base of the guiding grooves 47. This makes it possible to maintain even very tight yarn spacings A of 2 mm for example securely on the circumference of the runoff godet 14.

After runoff of the yarns 2.1 to 2.5 off the runoff godet 14, they are led into the runup plane 14 to the individual guiding rollers 11.1 to 11.5. Particularly the guiding rollers assigned to the outer yarns 2.1 and 2.5 are positioned such that the roller axis 15 of the guiding roller 11.1 to 11.5 has an inclination relative to the axis of the runoff godet 14 in order that the yarns running up may be taken up as straight as possible. Thus, the roller axis 15 of the guiding roller 11.1 has an angle of inclination $\beta_1$ which permits an essentially straight-line runup of the yarn 2.1 to the guiding roller. The guiding roller 11.5, by contrast, has an angle of inclination $\beta_2$ which, owing to the opposite deflection of the yarn 2.5, is configured oppositely. Owing to the smaller deflection of the yarn 2.5, the angle of inclination $\beta_2$ is smaller in the absolute amount than the angle of inclination $\beta_1$ of the guiding roller 11.1, which takes up the more strongly deflected yarn 2.1. Owing to the low deflection, the guiding rollers 11.2 to 11.4 are—without inclination—held parallel to the runoff godet axis. To make the angles of inclination $\beta_1$ and $\beta_2$ of the guiding rollers 11.1 and 11.5 equal in terms of their absolute amount, the runoff godet 14 can also be arranged such that the runup plane 44 defined by the head yarn guides 3.1 to 3.5 is asymmetrical to the guiding region of the yarns on the circumference of the godets.

Figure 5:
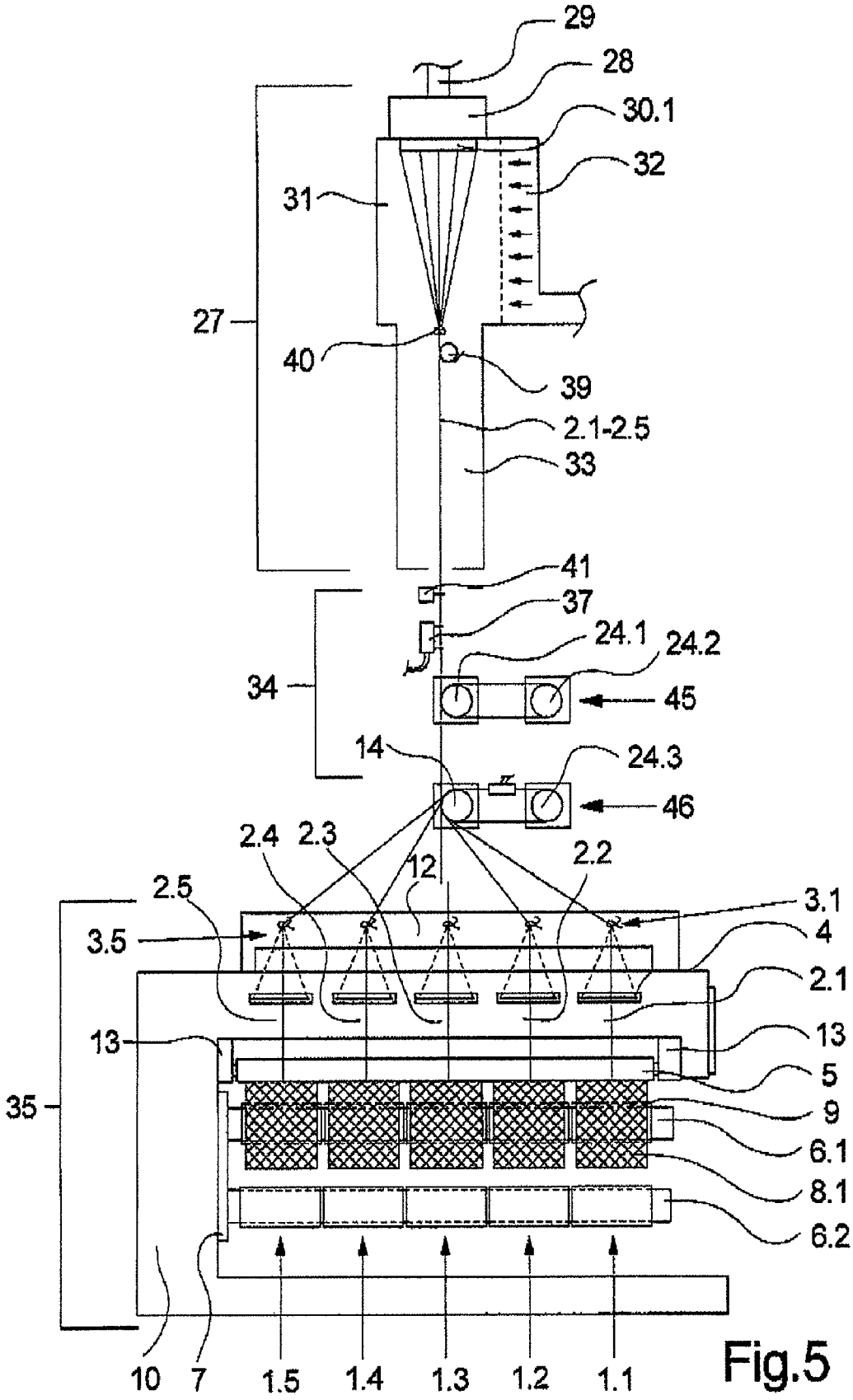
FIG. 5 and FIG. 6 each shows further operative examples of the apparatus of the present invention.
Figure 6:
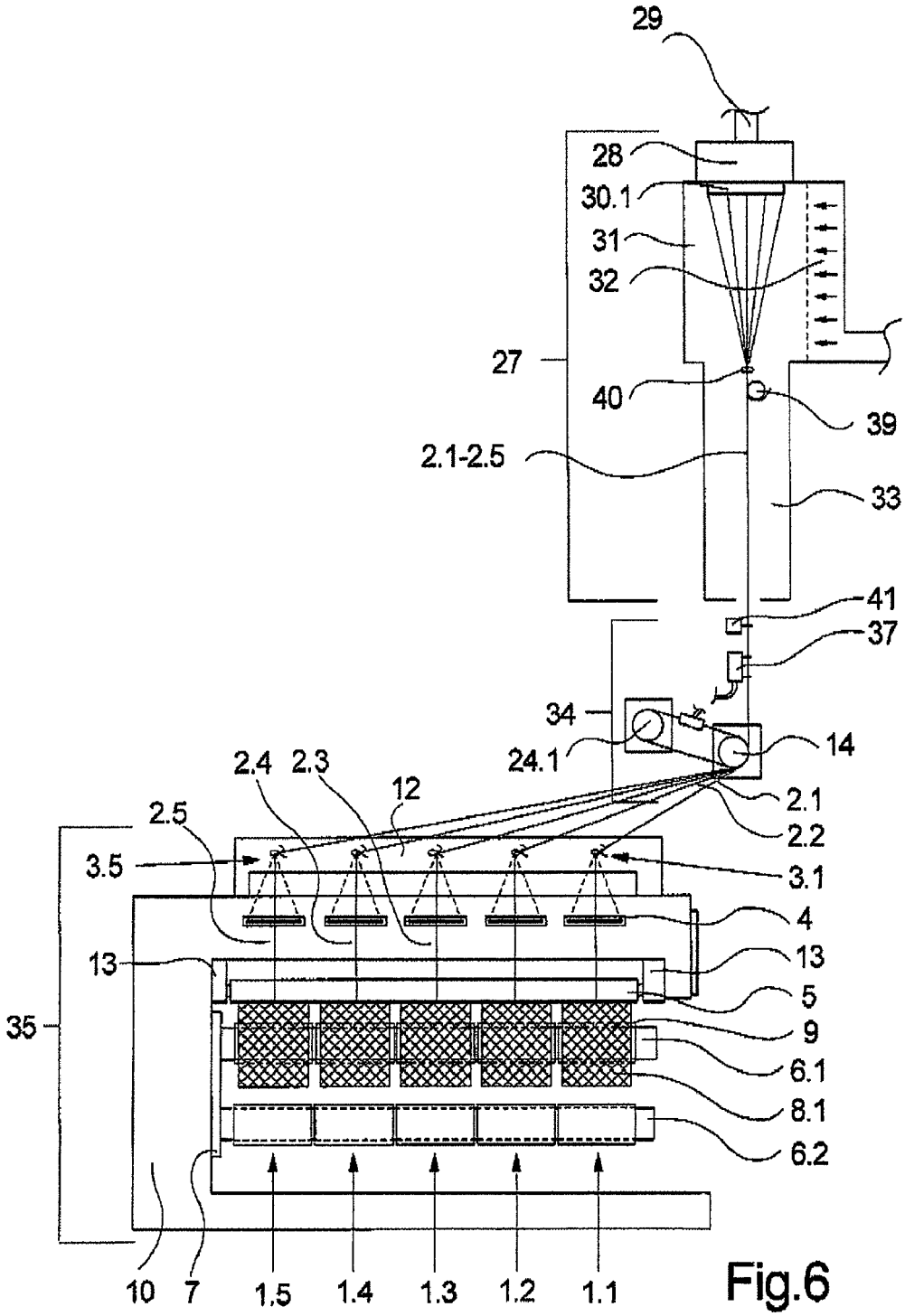

FIGS. 5 and 6 show further operative examples of an apparatus which is in accordance with the present invention and where essentially the treating appliances are formed by different godet systems. The construction and the arrangement of the spinning appliance and also of the windup machine are essentially identical to the preceding operative example according to FIGS. 1 to 3, so that only the differences to the treating appliances will be elucidated hereinbelow.

In the FIG. 5 operative example of the present invention's apparatus, the treating appliance is formed by a hauloff godet unit 45 and a drawing godet unit 46. The hauloff godet unit 45 comprises two godets 24.1 and 24.2, which are each driven by a separate godet drive (not depicted here). The hauloff godet unit 45 is formed by the runoff godet 14 and a third godet 24.3 assigned to the runoff godet 14. The runoff godet 14 and the godet 24.3 are likewise driven independently of each other. The hauloff godet unit 45 and the drawing godet unit 46 are each multiply wrapped by a yarn sheet, the hauloff godet unit 45 hauling off the yarn sheet out of the spinning appliance 27 disposed above the treating appliance 34. The hauloff godet unit 45 and the drawing godet unit 46 are driven at different speeds, so that the yarn sheet is drawn between the godet 24.1 and the runoff godet 14. To this end, the godets 24.1 and 24.2 of the hauloff godet unit 45 are preferably heated. After drawing, the yarns 2.1 to 2.5 are directly led from the runoff godet 14 to the head yarn guides of the windup machine 35. The runoff godet 14 is for this purpose disposed above the windup machine, in a horizontally oriented runoff plane 43. The runoff godet 14 is positioned in the central region of the winding stations 1.1 to 1.5. After runoff and deflection of the yarns from the runoff godet 14, the yarns 2.1 to 2.5 are led into the head yarn guides 3.1 to 3.5 of the windup machine 35. The head yarn guides 3.1 to 3.5 in this operative example are formed by yarn guides having an eyelet to guide the yarns. The head yarn guides 3.1 to 3.5 are directly followed by the traversing means to move the yarns side to side and deposit them on the package.

The FIG. 5 operative example of the present invention's apparatus is particularly suitable for producing fully drawn yarns (FDYs). The yarns are entangled by the entangling appliance 38, between the runoff godet 14 and the godet 24.3, before windup. The yarns are for this purpose led in a parallel side by side arrangement through the hauloff godet unit 45 and the drawing godet unit 46, the yarn spacing setting being in the range from 2 mm to 5 mm. This ensures compact designs even for multiple wrapping of the godets.

In the operative example depicted in FIG. 6, the runoff godet 14 of the treating appliance 34 is utilized not only for hauling off the yarns 2.1 to 2.5 out of the spinning appliance but also for distributing the yarns into the windup machine 35. The runoff godet 14 is in terms of construction and placement identical to the operative example of FIGS. 1 to 3, although in the operative example depicted here the runoff godet 14 is assigned a second godet. The second godet 24.1 and the runoff godet 14 are multiply wrapped by the yarn sheet, an entangling appliance 38 being positioned in the last yarn wrap between the godet 24.1 and the runoff godet 14. The multiple wrapping of the runoff godet 14 and of the assigned godet 24.1 makes it possible to achieve greater hauloff forces for hauling off the yarns 2.1 to 2.5 out of the spinning appliance. The runoff godet 14 and/or the second godet 24.1 can be constructed to be heatable. It is also possible to replace the second godet 24.1 with an undriven, freely rotatable, idler roller.

The operative examples of the apparatus according to the present invention which are shown in FIGS. 1 to 6 are illustrative in terms of the construction and choice of the individual processing assemblies. The present invention also comprehends similar apparatus which, although different in terms of the construction and choice of the individual processing assemblies, have absolutely no yarn guiding means between a last runoff godet and the head yarn guide of a windup machine, the runoff godet being disposed essentially transversely to the longitudinal axis of the windup machine.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for melt spinning and winding up synthetic yarns, said apparatus comprising:

a spinning appliance, a treating appliance, and a windup machine, wherein the treating appliance comprises a runoff godet configured for guiding the yarns before entry and distribution of the yarns into a plurality of winding stations of the windup machine, the runoff godet being arranged above the windup machine and configured to guide the yarns in a parallel side by side arrangement on its circumference, the runoff godet being arranged transversely to a winding spindle of the windup machine and the windup machine comprising a plurality of head yarn guides which are disposed upstream of the winding stations and are arranged in a vertically oriented runup plane, and wherein the head yarn guides are disposed downstream of the runoff godet immediately in the yarn path and such that an angle of deflection of the yarns off the runoff godet into the runup plane is not more than 15°.

2. The apparatus according to claim 1, wherein a surface of the runoff godet has an average roughness value from 0.2 μm to 0.8 μm.

3. The apparatus according to claim 1, wherein the runoff godet is assigned a guiding means configured for guiding a plurality of parallel yarns whereby a spacing in the range from 2 mm to 8 mm is determined between the yarns.

4. The apparatus according to claim 3, wherein the guiding means is formed by a plurality of yarn guides arranged side by side in a row which are disposed upstream of the runoff godet in the yarn path.

5. The apparatus according to claim 3, wherein the guiding means is formed by a plurality of radial guiding grooves located on a circumference of the runoff godet.

6. The apparatus according to claim 1, wherein the runup plane defined by the head yarn guides intersects an axis of the runoff godet in a middle guiding region.

7. The apparatus according to claim 1, wherein the treating appliance comprises a plurality of driven godets for guiding and drawing the yarns, and wherein the runoff godet being assigned at least a second godet in the yarn path.

8. The apparatus according to claim 7, wherein an entangling appliance is disposed between the runoff godet and the second godet whereby the yarns are synchronously entangled while in a parallel side by side arrangement.

9. The apparatus according to claim 1, wherein the head yarn guides in the windup machine are each formed by a freely rotatable guiding roller whose roller axes are oriented substantially orthogonally to a winding spindle of the windup machine.

10. The apparatus according to claim 9, wherein the roller axes of the guiding rollers have respective angles of inclination relative to the axis of the runoff godet as a function of the respective angles of deflection of the assigned yarn.

11. The apparatus according to claim 9, wherein the guiding rollers each comprise in their circumference a flute-shaped guiding track configured to guide the yarn.

12. The apparatus according to claim 1, wherein there are provided one or more auxiliary guiding appliances whereby yarn guiding operations are executable during at least one of a processing start, a processing interruption, and a bobbin change in the windup machine.

* * * * *